United States Patent [19]

Sanders

[11] Patent Number: 4,830,036

[45] Date of Patent: May 16, 1989

[54] PORTABLE CAR TOP TENT

[76] Inventor: Charles W. Sanders, 2153 S. El Marino, Mesa, Ariz. 85202

[21] Appl. No.: 114,764

[22] Filed: Oct. 30, 1987

[51] Int. Cl.[4] ..... E04H 15/06

[52] U.S. Cl. ..... 135/88; 135/113; 135/904; 135/102

[58] Field of Search ..... 135/102, 88, 113, 116, 135/904

[56] References Cited

U.S. PATENT DOCUMENTS

| | | | |
|---|---|---|---|
| 2,804,083 | 8/1957 | Wieber | 135/113 X |
| 4,058,133 | 11/1977 | Barr et al. | 135/113 X |
| 4,099,534 | 7/1978 | Corbin | 135/904 X |
| 4,223,689 | 9/1980 | Cox | 135/88 X |
| 4,366,979 | 1/1983 | Pillot | 135/88 X |
| 4,471,793 | 9/1984 | Cattaneo | 135/904 X |

FOREIGN PATENT DOCUMENTS

| | | | |
|---|---|---|---|
| 1154051 | 4/1958 | France | 135/113 |
| 89003 | 4/1957 | Norway | 135/113 |

*Primary Examiner*—Henry E. Raduazo
*Attorney, Agent, or Firm*—Victor Flores; Harry M. Weiss

[57] ABSTRACT

A collapsibe tent for mounting on the roof of an automotive vehicle or other surface includes a two-piece foldable platform, a collapsible frame, and a tent cover which is drawn into a tubular form resembling the top of a Conestoga wagon when the platform is unfolded and the frame erected. The frame includes a front support arch and a rear support arch, each of which is pivotable from a horizontal position parallel to the platform to a vertical position perpendicular to the platform. When the arches are in the vertical position, each leg of the arch is automatically and releasably locked into place by means of a compression spring which is carried on the mounting pin which connects that leg to the platform and which biasingly urges the leg into a notch in the sidewall of the platform when the leg is in a vertical position.

17 Claims, 4 Drawing Sheets

FIG. 1
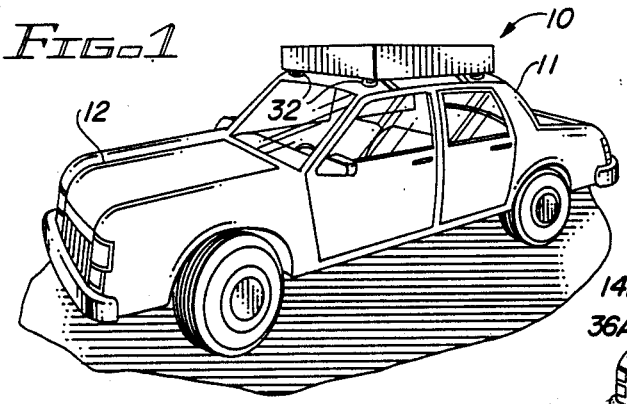
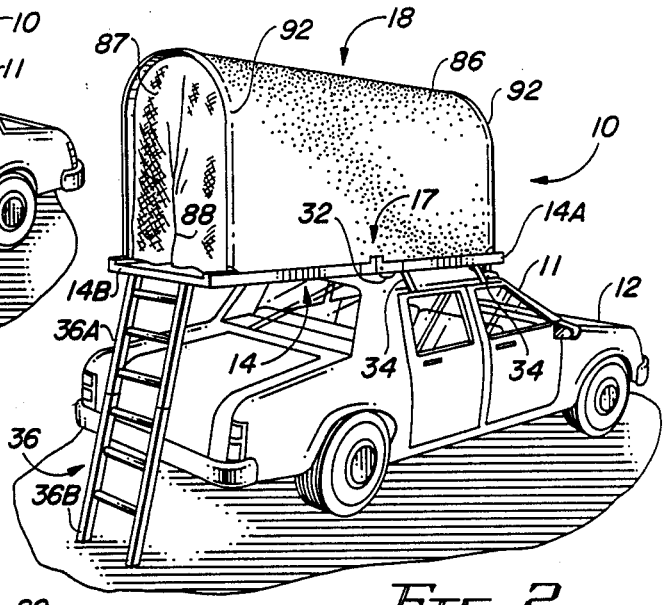
FIG. 2
FIG. 3
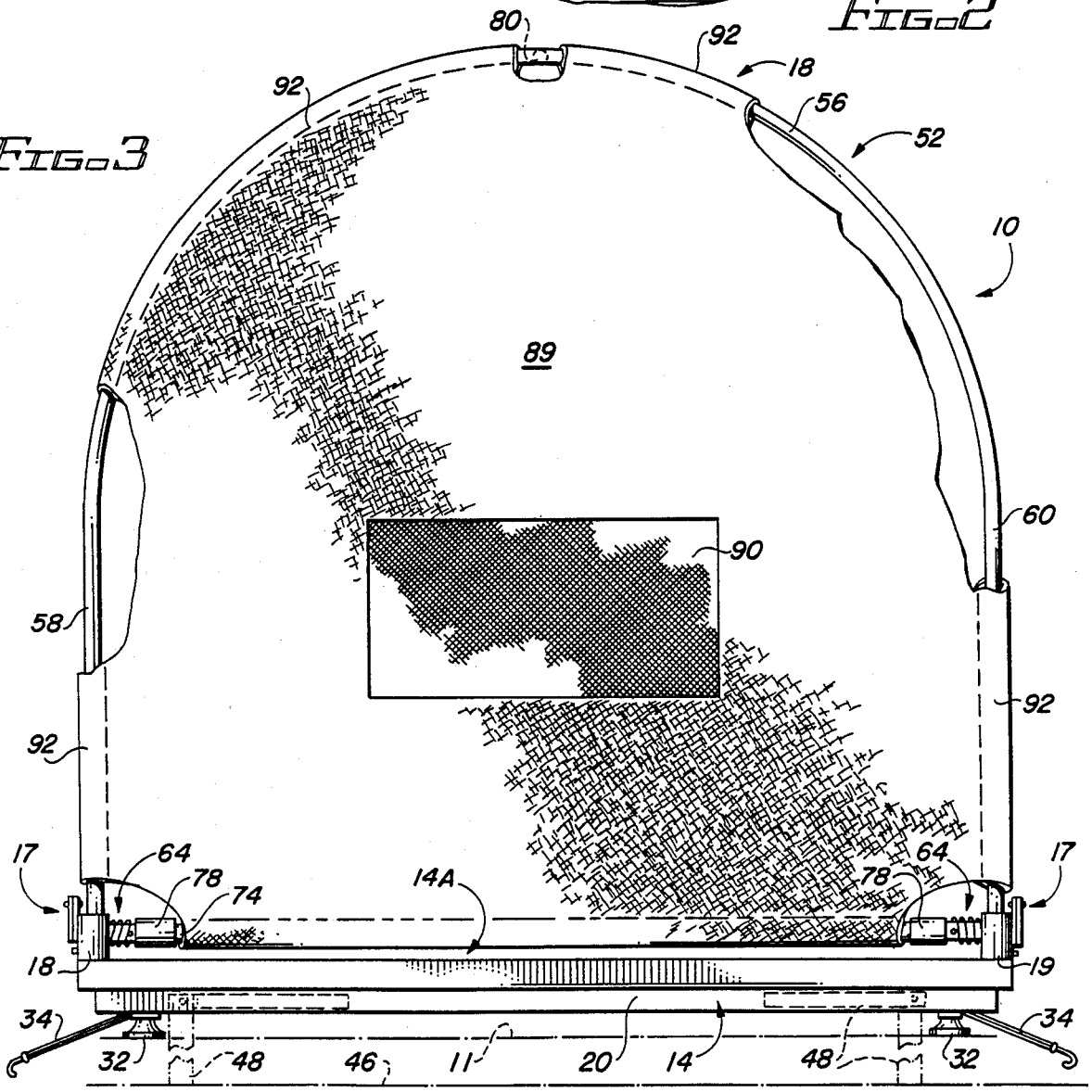

18
52
66
64
62
14A
58
68
72
70
78
74

52
58
62
18
64
14A
50
20
48
11
32
48
46

52
58
18
64
62
66
72
78
68
70
14A
74

38
43
42
45
44
40

39
39
36A
36
42
36B
42
38
38
40
40
45
45

85
56
84
52
80
82

23
26
17
28
28
30
27
26
19
27
14B
24
14A
21
19
56
84
54
85

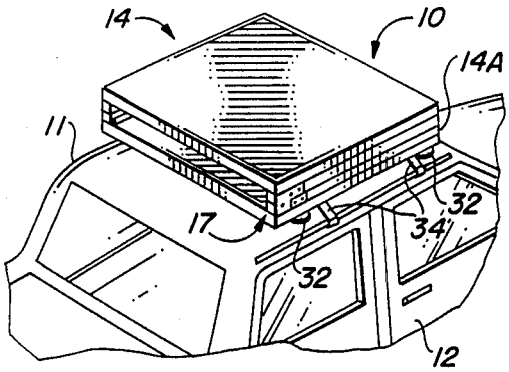
FIG. 12A
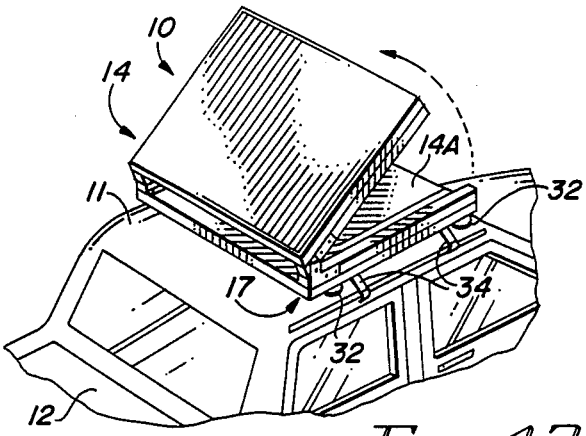
FIG. 12B
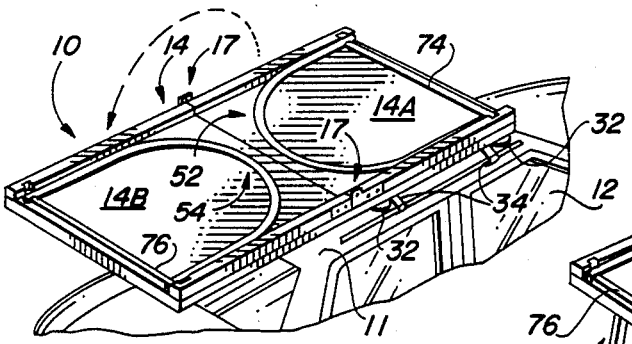
FIG. 12C
FIG. 12D
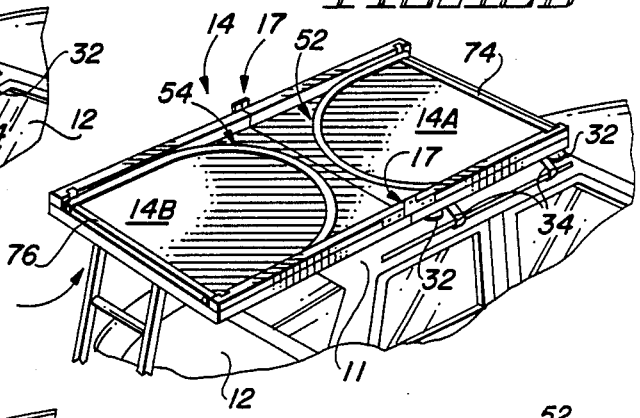
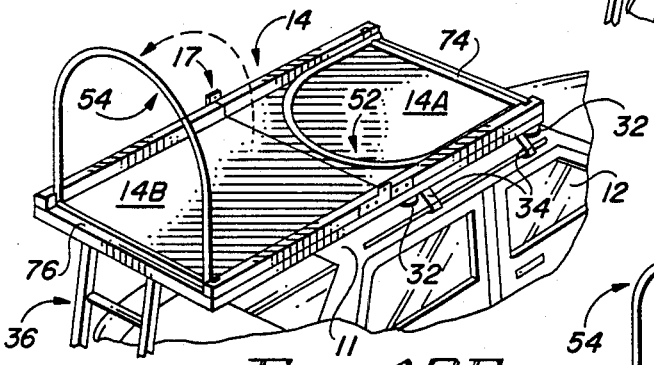
FIG. 12E
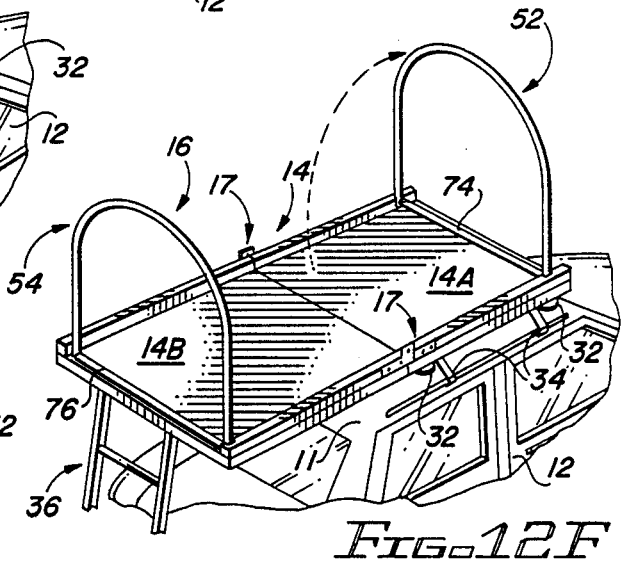
FIG. 12F
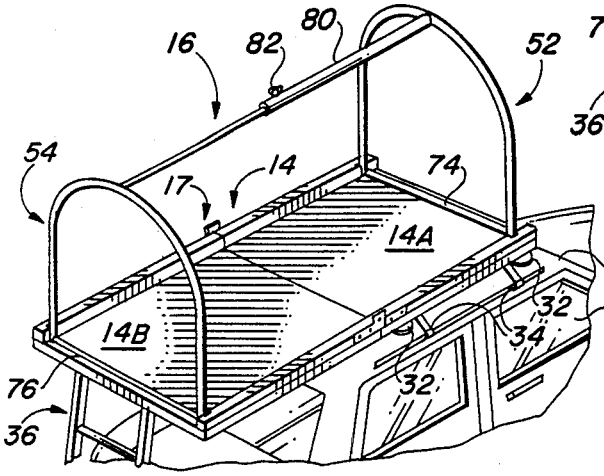
FIG. 12G

PORTABLE CAR TOP TENT

BACKGROUND OF THE INVENTION

1. Field of the Invention

This invention relates in general to tent structures and, more particularly, to a Conestoga-style collapsible tent assembly for mounting on the roof of an automotive vehicle or other surface.

2. Description of the Prior Art

The numerous problems associated with conventional ground level camping, such as overcrowded campgrounds and space shortages, damp, rocky, and/or pest-infested soil and the like, have led to many attempts to develop compact, collapsible tents for mounting on elevated surfaces such as car tops. Representative examples of such tents are disclosed in U.S. Pat. No. 2,531,678 to Gledhill; U.S. Pat. No. 3,093,150 to Schaftener et al; U.S. Pat. No. 3,375,836 to Domeneghetti; U.S. Pat. No. 4,058,133 to Barr et al, U.S. Pat. No. 4,111,479 to Rizzotto, Sr.; and U.S. Pat. No. 4,471,793 to Cattaneo.

Public acceptance of these earlier car top tents has not been widespread, however, possibly due to factors such as high cost, weight, bulkiness, inconvenience of assembly, slow set-up time, unsteady support structures, and unattractive appearance.

Accordingly, a need is felt for a new and improved car top tent assembly which overcomes some of the problems of the prior art.

BRIEF SUMMARY OF THE INVENTION

In accordance with the present invention, a new and improved Conestoga-style collapsible tent assembly is provided for mounting on the roof of an automotive vehicle.

The tent assembly comprises a lightweight folding platform which supports a collapsible frame. A flexible tent cover is secured to the frame in such a way that when the platform is unfolded the cover is drawn into a generally tubular form resembling the cover of a Conestoga wagon, and when the frame is collapsed, the tent cover will collapse with it.

The folding platform includes a first rigid panel adapted to be supported above the roof of a motor vehicle, and a second rigid panel hingedly secured to the first panel. The panels are lightweight and foldable from a closed configuration in which the second panel overlies the first panel to an open configuration in which the second panel extends outwardly from the vehicle top in contiguous, coplanar relation with the first panel. Each panel is provided with a pair of upstanding sidewalls which extend along opposite longitudinal edges of the platform to define the side boundaries of the tent.

The collapsible frame includes a pair of tubular support arches including a front arch and a rear arch, each arch being mounted at one of the opposite ends of the folding platform. Each arch is mounted for pivotable movement from an upstanding operative position perpendicular to the platform to an inoperative folded position substantially parallel to the plane of the platform. In addition, a pair of horizontally extending floor rods is provided for anchoring and rigidifying the bottom front and rear edges of the tent cover. Also, a ridgepole is provided for insertion between the tops of the arches in order to provide rigidification of the arches and to prevent the tent cover from sagging.

One feature of particular importance in the tent of the present invention is a special automatic locking means provided at the pivotable interconnection between each of the tubular support arches and the folding platform for locking the arches in their operative position. The locking means comprises a pair of notches formed in each of the upstanding sidewalls of the platform with each notch being proximate the bottom of a different one of the legs of each of the arches. A mounting pin projects inwardly from each of these notches toward the center of the platform. The bottom of each leg of each arch is formed as an apertured flange which is loosely mounted for rotation and axial movement on a corresponding one of the mounting pins. Stop means such as a cross pin is provided at the distal end of the mounting pin, and biasing means such as a compression spring is carried on the mounting pin between the arch and the stop means. When an arch is in its inoperative position, i.e. substantially parallel to the plane of the platform, the sidewalls of the platform press and hold the bottom of the legs of each arch in inwardly displaced misaligned relationship with respect to notches provided in the sidewalls of the platform. However, once the arch has been pivoted to an upright position, the legs are aligned with the notches in the sidewalls thus allowing the biasing means to expand outwardly to move and lock the legs in place within the notches of the sidewalls. Conversely, in order to return an arch to its inoperative position, it is simply necessary to squeeze the legs of the arch inwardly against the bias of the spring until the bottom of each leg escapes from its corresponding notch, allowing the arch to be pivoted back downwardly. Thus, the procedures for setting up and taking down the tent are very simple and can be performed in a matter of seconds.

Accordingly, it is an object of this invention to provide a new and improved collapsible tent assembly for mounting on the roof of an automotive vehicle.

Another object of the invention is to provide a collapsible car top tent assembly with a simple, automatic, locking means for quickly and securely locking the support arches of the tent in a vertical operative position.

Still another object of the invention is to provide a lightweight, compact car top tent which is inexpensive to manufacture and attractive in appearance.

The foregoing and other objects of the present invention, as well as the invention itself, may be more fully understood from the following description when read in conjunction with the accompanying drawings.

BRIEF DESCRIPTION OF THE DRAWINGS

FIG. 1 is a perspective view from the front showing the tent assembly of the present invention mounted in its collapsed state on the roof of an automotive vehicle.

FIG. 2 is a perspective view from the rear showing the tent assembly in its fully erected state on the roof of the automobile.

FIG. 3 is an enlarged front view of the tent assembly of the present invention with portions being broken away to show some of the features thereof.

FIGS. 12A–G are a series of diagrammatic views showing the set-up sequence for the car top tent assembly of the present invention, with the flexible tent cover being omitted for the sake of clarity.

DESCRIPTION OF THE PREFERRED EMBODIMENTS

Figure 4:
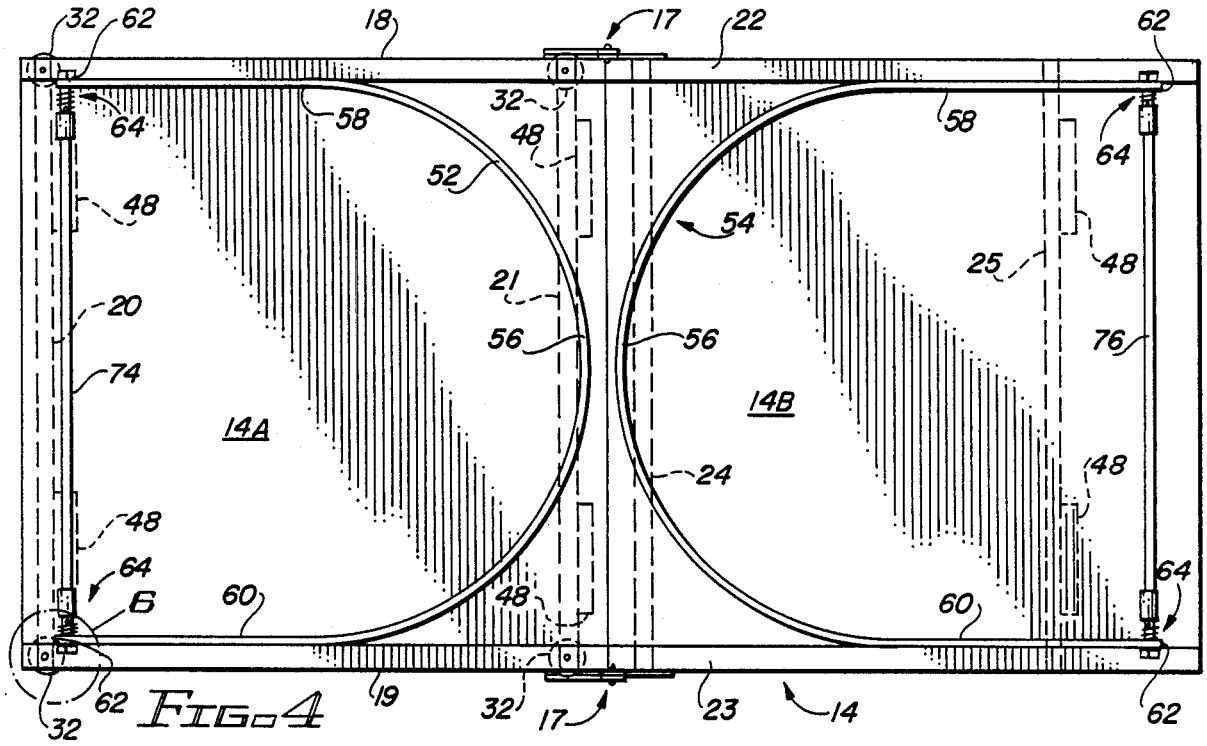
FIg. 4 is a top view showing the platform of the tent assembly of the present invention, with the support arches folded to their inoperative position and having the tent cover removed for clarity.

Referring more particularly to the drawings, FIGS. 1 and 2 show the collapsible tent assembly 10 of the present invention, in its collapsed and expanded states, respectively. For the sake of convenience, the assembly 10 is shown on the roof 11 of a conventional automotive vehicle 12. However, the assembly need not be limited to roof top mounting arrangements, but can also be supported directly on the ground or on other surfaces such as the bed of a pick-up truck as will be described later. Furthermore, when mounted on a vehicle 12, the tent assembly 10 may be adapted to extend outwardly in a sideways direction with respect to the vehicle, rather than rearwardly as illustrated.

The tent assembly 10 comprises a folding platform 14 which supports a collapsible frame 16 (best seen in its entirety in FIG. 12G). A flexible tent cover 18 is secured to the frame 16 in such a way that when the platform 14 and the frame 16 are unfolded, the cover 18 will unfold with them and thus be drawn into a generally tubular form resembling the cover of a Conestoga wagon. Also, similarly, when the frame 16 is collapsed and the platform 14 is folded, the tent cover 18 will be collapsed and folded along with them.

The folding platform 14 includes a first floor panel 14A adapted to be supported on a flat surface, such as the roof 11 of the automotive vehicle 12, and a second floor panel 14B, which is connected to one end of the first floor panel 14A by means of a pair of structurally identical hinges 17, as will hereinafter be described.

The folding platform 14 must, of course, be rigid and durable, but to facilitate handling of the tent assembly 10, the platform should also be lightweight. An ideal structure having these characteristics includes a styrofoam panel which is laminated between two sheets of aluminum. Therefore, it is preferred that both the first and second floor panels 14A and 14B be fabricated in this manner.

Figure 5:
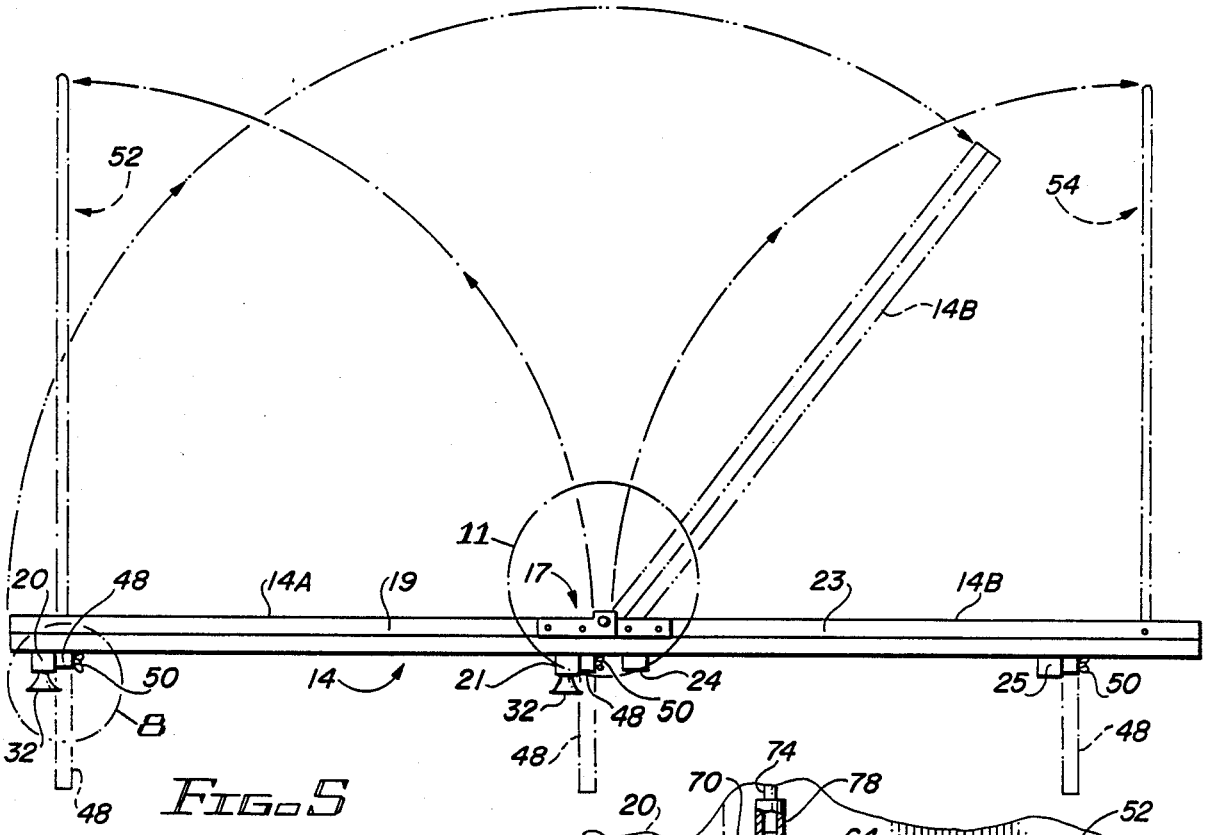
FIG. 5 is a side view of the platform of FIG. 4.

As seen best in FIGS. 4 and 5, the first floor panel 14A is provided with a pair of upstanding sidewalls 18 and 19 on the upper surface thereof and which extend longitudinally along opposed side edges of the panel. Also, the first floor panel 14A is provided with a pair of transverse beams 20 and 21 on the lower surface thereof and which extend longitudinally along opposed end edges of the panel. Similarly, the second floor panel 14B is provided with a pair of opposed upstanding sidewalls 22 and 23 and a pair of transverse beams 24 and 25. In addition to adding to the rigidity of the floor panels, the sidewalls 18, 19, 22 and 23 are used for mounting the collapsible frame 16 to the folding platform 14, and the transverse beams 20, 21, 24 and 25 are used for attaching tent support structures to the assembly 10, as will hereinafter be described in detail.

Figures 7A, 7B, 8, 9, 10A, 10B, 11:
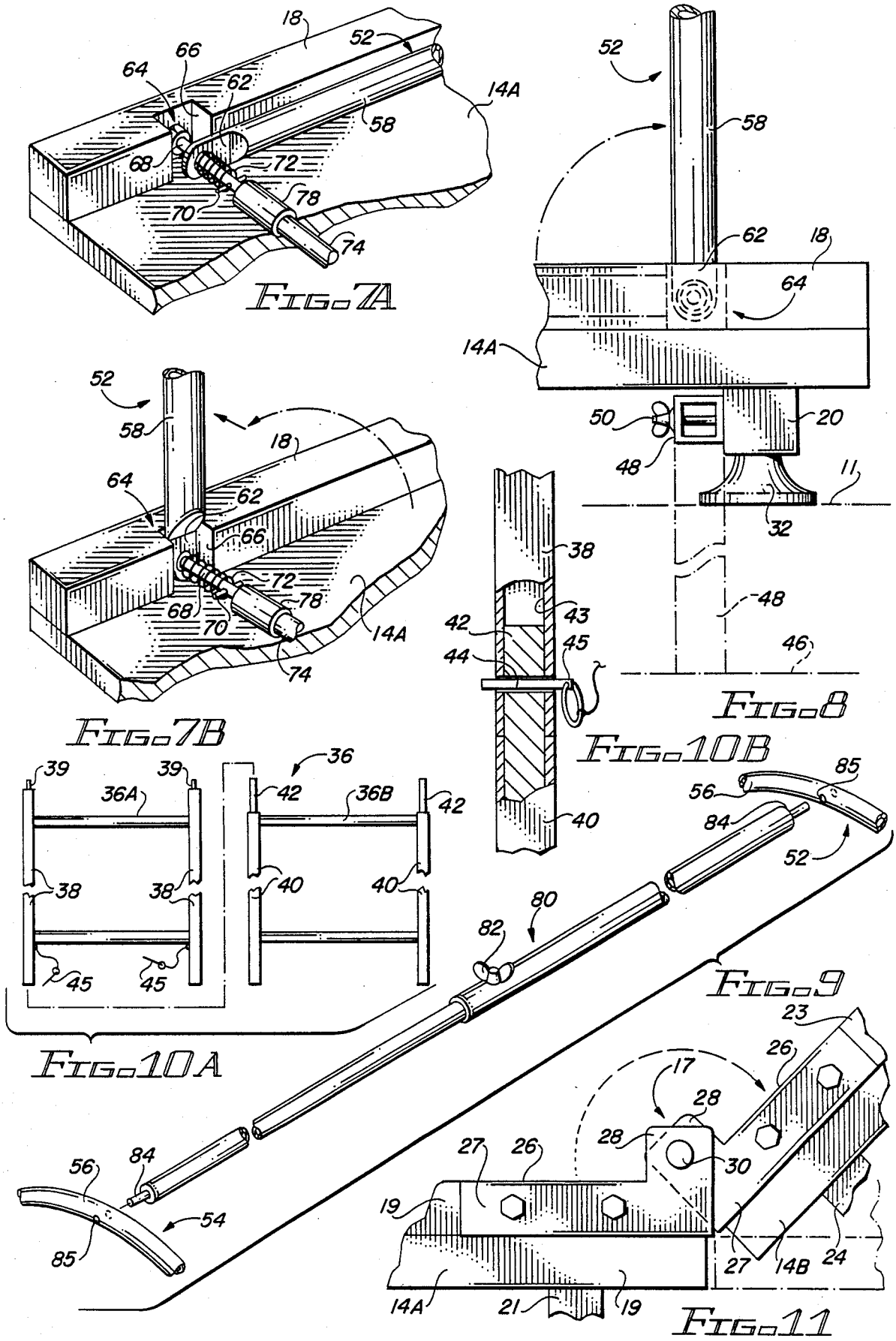
FIG. 7A is a fragmentary perspective view of the locking means of FIG. 6, showing a support arch in an unlocked, inoperative position.
FIG. 7B is a view similar to FIG. 7A showing the support arch in a locked operative position.
FIG. 8 is an enlarged fragmentary view of the circled region 8 in FIG. 5.
FIG. 9 is an enlarged fragmentary view in perspective showing the ridgepole of the tent assembly in exploded relation to the support arches of the frame.
FIG. 10A is an exploded front view of the step ladder used with the collapsible tent assembly of the present invention.
FIG. 10B is an enlarged fragmentary sectional view showing the step ladder of FIG. 10A after being assembled.
FIG. 11 is an enlarged fragmentary view of the circled region 11 in FIG. 5, showing one of the hinges connecting the panel elements of the folding platform of the tent assembly.

As mentioned above, the hinges 17 which are used to interconnect the first and second floor panels 14A and 14B of the folding platform 14, are structurally identical, and a typical one of those hinges 17 is shown in detail in FIG. 11. The hinge 17 comprises a pair of plate members 26 each of which includes a rectangular mounting portion 27 that is bolted or otherwise securely fastened to adjacent ends of the upstanding sidewalls 19 and 23 of the first and second floor panels 14A and 14B respectively. Each of the plate members 26 further includes an ear portion 28 which extends perpendicularly to the mounting portion 27 thereof, with the two ears 28 of the plates being in overlaying contiguous engagement with each other and interconnected by means of a suitable pivot pin 30.

The hinges 17, therefore, allow the second panel 14B to be pivoted about a horizontal axis above the platform from an unfolded closed position in which the second panel 14B overlies the first panel 14A to an open position in which the second panel 14B extends outwardly in aligned, juxtaposed, and coplanar relation with the first panel 14A.

When the tent assembly 10 is intended for use on the roof 11 of the automotive vehicle 12 as shown in FIGS. 1, 2 and 12A–G, the first panel 14A of the platform 14 is supported on the roof 11 by means of a plurality of feet 32, such as suction cups, which depend from the opposite ends of the transverse beams 20 and 21 of the panel 14A and is held in place by tie-down straps 34 or the like, which may be attached, for example, in hooked engagement with the rain gutters of the vehicle 12. In addition, when the platform 14 is unfolded to its open position, the second floor panel 14B is supported above the ground by means of a ladder 36, which serves to brace the entire tent assembly 10 as well as to provide access to the interior thereof.

As shown in FIGS. 10A and 10B, the ladder 32 is preferably of two-piece knock-down construction, comprising an upper ladder element 36A and a lower ladder element 36B. The upper ladder element 36A comprises a pair of tubular side rails 38, each of which terminates at its upper end with a curved pin member 39 adapted for hooked engagement with suitable openings (not shown) in the bottom surface of the platform 14 to secure the ladder 36 thereto. Each of the side rails 40 of the lower ladder element 36B terminates at its upper end with a cylindrical peg 42 adapted to be slideably received in the lower end of the bore 43 of a corresponding one of the tubular side rails 38 of the upper ladder element 36A. Each of the cylindrical pegs 42 and the lower ends of the tubular side rails 38 of the upper ladder element 36A, are provided with openings which cooperatively form a transverse passage 44 when the upper and lower ladder elements 36A and 36B are connected together, and suitable pull pins 45 are provided for locking the ladder elements together. This knock-down arrangement allows the ladder 36 to be conveniently stored and transported underneath, above, or inside the folded platform 14 when not in use, thus requiring a minimum amount of storage space.

When the tent assembly 10 is intended to be set up on the ground, in the bed of a pick up truck (not shown) or other similar surface, which is indicated in dashed lines at 46 in FIGS. 3 and 8, the above described ladder 36 is, of course, not needed. Instead, the tent assembly 10 may be supported in an elevated position relative to the surface 46 by means of a plurality of folding legs 48. It has been found that a total of six folding legs 48 provide a sufficient amount of support. A first pair of the folding legs 48 are mounted on opposite ends of the transverse beam 20 of the first floor panel 14A and a second pair of the legs 48 are similarly mounted to the other transverse beam 21 thereof. A third pair of the folding legs 48 are mounted on the opposite ends of the transverse beam 25 of the second floor panel 14B. The legs 48 are each attached to their respective ones of the transverse beams 20, 21 and 25 by suitable fasteners, such as the bolt-wing nut assembly 50 seen best in FIG. 8. When the fastener assemblies 50 are loosened, the legs 48 are pivotably movable from the stored position shown in solid lines in FIG. 8, to the depending platform supporting position shown in dashed lines in the same figure.

The collapsible frame assembly 16 of the tent assembly 10 includes an identical pair of tubular support arches 52 and 54, each of which is provided with an arcuate bight portion 56 and a pair of legs 58 and 60 which extend in parallel spaced apart relationship from opposite ends of the bight portion. The arches 52 and 54 are mounted at opposite ends of the folding platform 14, and are pivotably movable from an operative position, wherein they extend normally and upwardly from the platform to an inoperative position wherein they lie on the platform in substantially parallel relationship therewith.

Figure 6:
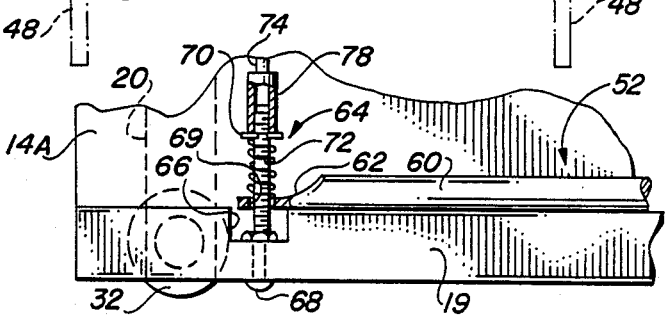
FIG. 6 is an enlarged fragmentary view of the circled region in FIG. 4, showing the locking means of the tent assembly.

Each of the arches 52 and 54 are provided with a flange means on the bottom end of each leg 58 and 60 thereof as shown best at 62 in FIGS. 6, 7A and 7B. The flange means 62 are ach coupled to the platform 14 by a special mounting means 64, which not only allows the above mentioned pivotable movement of the arches 52 and 54, but also provides means for automatically locking the arches in their upright operational positions and for simplified unlocking which enables the arches to be pivoted from their operational positions into their folded inoperative positions.

The four mounting and automatic locking means 64 are identical to each other, and the following description of the mounting and locking means 64 shown in FIG. 6, will be understood to also apply to the other three. An inwardly and upwardly opening notch 66 is formed in the upstanding sidewall 19 of the first floor panel 14A, proximate the end thereof which is furthest from the second floor panel 14B. A mounting pin 68 is fixedly carried by the sidewall 19 so as to extend through the notch 66 and protrude therefrom in overlaying relationship with the top surface of the floor panel 14A. The flange means 62, provided on the leg of the arch, is provided with a suitable aperture 69 with the mounting pin 68 extending loosely through the aperture. A cross pin 70 is mounted proximate the inwardly extending end of the mounting pin 68, and a biasing means such as the illustrated compression spring 72 is concentrically mounted on the mounting pin 68 between the cross pin 70 and the flange means 62.

When the arch 52 is in its inoperative folded position, i.e. parallel to the plane of the first floor panel 14A, the legs 58 and 60 are biased by the springs 72 into bearing engagement with the inwardly facing surfaces of the sidewalls 18 and 19 of the first floor panel 14A. Similarly, when the arch 54 is folded in its inoperative state, the legs 58 and 60 thereof are biased into bearing engagement with the inwardly facing surfaces of the sidewalls 22 and 23 of the floor panel 14B.

When the arches 52 and 54 are pivotably moved into the upstanding operative positions, for setting up the tent assembly 10 as will hereinafter be described in detail, the lower ends of the legs 58 and 60 of the arches 52 and 54 will move out of bearing engagement with the inwardly facing surfaces of the sidewalls 18, 19, 22 and 23 of the platform 14 into alignment with the notches 66 thereof. When such alignment occurs, the compression springs 72 will biasingly push the lower ends of the arms 58 and 60 into their respective notches 66, thus automatically locking the arches 52 and 54 in their upstanding operative positions. In order to return the arches 52 and 54 to their folded inoperative positions, a simple pushing force applied in a direction which causes the lower ends of the legs 58 and 60 to move toward each other, will free them from the notches so that the downward pivoting movement of the arches 52 and 54 may be accomplished.

The collapsible frame assembly 16 further includes a pair of horizontally extending cross rods 74 and 76, with the cross rod 74 extending between the mounting and locking means 64 of the arch 52, and the other cross rod 76 extending similarly between the mounting and locking means 64 of the arch 54. Each of the cross rods 74, 76 has a sleeve 78 slideably mounted on its opposite ends for receiving the extending ends of the mounting pins 68 of the mounting and automatic locking means 64, as best seen in FIG. 6. Therefore, the cross rods 74 and 76 are demountably attached so as to extend transversely between the lowermost ends of the legs 58 and 60 of their respective arches 52 and 54, and the cross rods are used for tying down the tent cover 18 as will hereinafter be described in detail.

In addition, the frame assembly 16 further includes a ridgepole 80 which is mounted so as to extend between the bight portions 56 of the arches 52 and 54 when they are in their upstanding positions. The ridgepole 80, of course, stabilizes the upright positioning of the frame assembly 16 and supports the tent cover 18. As seen in FIG. 9, the ridgepole 80 is preferably telescopically adjustable with a fastener means 82 being provided to fix the pole in the desired telescopically extended position. Each end of the ridgepole 80 is provided with an axially extending pin 84 which is demountably received in a suitably dimensioned hole 85 provided in the bight portions 56 of the arches 52 and 54.

The tent cover 18, which is constructed from a durable, weatherproof material such as lightweight canvas or, preferably, nylon ripstock, comprises a central roof portion 86, which extends longitudinally between the arches 52 and 54 of the frame 16, a rear flap portion 87 which extends across the space enclosed by the rear rach 54, defining a door 88 into the tent enclosure, and a front panel 89 which spans the area enclosed by the front arch 52 and which may include a window 90 covered by nylon screen material. In addition, bottom portion (not shown) may be provided so as to extend between the horizontal cross rods 74 and 76, of the frame, forming the floor of the tent assembly 10. The central roof portion 86, the rear flap panel 87, the front panel 89 and the bottom tent floor (not shown), are preferably stitched or otherwise attached to one another by techniques well knwon in the art, and are fastened to the frame 16 by means of fabric extension portions 92 of the cover 18, which have been looped around the appropriate tubular frame elements in the manner seen best in FIG. 3, and preferably stitched into place. Alternatively, the cover 18 may be removably secured to the frame 16 by means of releasable fasteners such as snaps or the like (not shown), but permanent fastening means such as stitching is thought to be more desirable since it is less costly and since there is generally no need to remove the cover 18 from the frame 16 once it has been installed.

The procedure for setting up the tent assembly 10 is illustrated diagrammatically in FIGS. 12A–12G. The tent cover 18 has been omitted for the sake of clarity, but would be left in place on the frame during actual use. FIG. 12A shows the assembly in is closed configuration on the roof 11 of the automobile 12. The first step in the set-up procedure is to unfold the platform 14 by pivoting the second panel 14B about the hinges 17 until the platform is in its open configuration, as shown in FIGS. 12B and 12C. Next the ladder 36 is positioned underneath the second panel 14B as shown in FIG. 12D. The support arches 52 and 54 are then swung upwardly into their vertical, operative positions, as shown in FIGS. 12E and 12F. Finally, the ridgepole 80 is inserted between the support arches 52, 54, as shown in FIG. 12G, and threaded through a pocket (not shown) formed in the upper roof portion 86 of the tent cover 18, thereby expanding the tent to the desired taut, tubular form.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A collapsible tent assembly comprising:

(a) a platform means having opposite ends and a pair of upstanding sidewalls each of which extends longitudinally along opposite sides of said platform, said platform being adapted with a plurality of support means for automotive vehicle, ground and other planar surface utilization;

(b) a pair of support frame means each mounted at a different one of the opposite ends of said platform, each of said support frame means including a spaced apart pair of legs with each of said legs having an extending end, said pair of support frame means being movable from operative upstanding positions normal to said platform to inoperative upstanding positions normal to said platform to inoperative folded positions parallel to said platform;

(c) a flexible tent cover attached to said support frame means; and (d) mounting and locking means for pivotably mounting said pair of support frame means on said platform and automatically releasably locking said support frame means in their operative upstanding positions when they are pivotably moved into their operative upstanding positions, said mounting and locking means including, I. each of the sidewalls of said platform having a pair of inwardly and upwardly opening notches formed therein with each notch being located proximate an extending end of a different one of the legs of said pair of support frame means, II. a mounting pin carried by said sidewalls of platform adjacent each of the notches formed therein, each of said mounting pins extending through its respective one of said notches in overlaying relationship with said platform, each of said mounting pins having the extending end of a different one of the legs of said support frame means pivotably and axially movably mounted thereon, III. a cross pin carried proximate the extending end of each of said mounting pins, IV. biasing means mounted on each of said mounting pins between said cross pins thereof and the extending ends of the legs of said support frame means for biasing said legs into bearing engagement with the inwardly facing surfaces of the sidewalls of said platform when said support frames means are in the folded inoperative positions thereof, and for biasingly urging the extending ends of the legs of said support frame means into the notches of said sidewall for automatically and releasably locking said support frame means in the upstanding operative positions.

2. A collapsible tent assembly as claimed in claim 1 wherein said platform means comprises:

(a) a first planar floor panel;

(b) a second planar floor panel; and (c) hinge means connecting said second floor panel to said first floor panel for hinged movement of said second floor panel from a first position of overlaying said first floor panel to a second position of juxtaposed coplanar alignment with said first floor panel.

3. A collapsible tent assembly as claimed in claim 2 wherein said plurality of support means includes means for demountable attachment to the roof of an automotive vehicle.

4. A collapsible tent assembly as claimed in claim 3 and further comprising ladder means for supportive placement between said second planar floor panel and the ground when said second planar floor panel is in the second position thereof and said platform means is mounted on the roof of the automotive vehicle.

5. A collapsible tent assembly as claimed in claim 2 wherein said plurality of support means includes a plurality of folding legs pivotably attached to said platform means, said legs being pivotably attached for allowing movement of said folding legs between a stored position below and parallel to said platform means, and a depending position, said folding legs being used for supporting said platform means in an elevated position relative to a planar surface.

6. A collapsible tent assembly as claimed in claim 1 wherein each of said support frame means is of tubular construction having an arcuate bight portion with said pair of legs of said support frame means extending in parallel relationship from the opposite end of said arcuate bight portion.

7. A collapsible tent assembly as claimed in claim 6 and further comprising a ridgepole having opposed ends for demountable attachment to the bight portions of said support frame means so as to extend therebetween when said support frame means are in their operative upstanding positions.

8. A collapsible tent assembly as claimed in claim 1 and further comprising a pair of cross rods extending horizontally between the extending ends of the legs of each of said support frame means for securing said tent cover to said platform means.

9. The collapsible tent assembly of claim 8, in which each end of each of said cross rods includes a slideably mounted sleeve member, said sleeve member defining a bore for receiving the extending end of one of said mounting pins.

10. A collapsible tent assembly comprising:

(a) a platform means having opposite ends and a pair of upstanding sidewalls each of which extends longitudinally along opposite sides of said platform, said platform being adapted with a plurality of support means for automotive vehicle, ground and other planar surface utilization, said plurality of support means comprising a plurality of folding legs pivotably attached to said platform means, said legs being pivotably attached for allowing movement of said folding legs between a stored position below and parallel to said platform means, and a depending position, said folding legs being used for supporting said platform means in an elevated position relative to a planar surface;

(b) a pair of support frame means each mounted at a different one of the opposite ends of said platform, each of said support frame means including a spaced apart pair of legs with each of said legs having an extending end, said pair of support frame means being movable from operative upstanding positions normal to said platform to inoperative upstanding positions normal to said platform to inoperative folded positions parallel to said platform;

(c) a flexible tent cover attached to said support frame means; and (d) mounting and locking means for pivotably mounting said pair of support frame means on said platform and automatically releasably locking said support frame means in their operative upstanding positions when they are pivotably moved into their operative upstanding positions, said mounting and locking means including, I. each of the sidewalls of said platform having a pair of inwardly and upwardly opening notches formed therein with each notch being located proximate an extending end of a different one of the legs of said pair of support frame means, II. a mounting pin carried by said sidewalls of platform adjacent each of the notches formed therein, each of said mounting pins extending through its respective one of said notches in overlaying relationship with said platform, each of said mounting pins having the extending end of a different one of the legs of said support frame means pivotably and axially movably mounted thereon, III. a cross pin carried proximate the extending end of each of said mounting pins, IV. biasing means mounted on each of said mounting pins between said cross pins thereof and the extending ends of the legs of said support frame means for biasing said legs into bearing engagement with the inwardly facing surfaces of the sidewalls of said platform when said support frames means are in the folded inoperative positions thereof, and for biasingly urging the extending ends of the legs of said support frame means into the notches of said sidewall for automatically and releasably locking said support frame means in the upstanding operative positions.

11. A collapsible tent assembly as claimed in claim 10 wherein said platform means comprises:

(a) a first planar floor panel;

(b) a second planar floor panel; and (c) hinge means connecting said second floor panel to said first floor panel for hinged movement of said second floor panel from a first position of overlaying said first floor panel to a second position of juxtaposed coplanar alignment with said first floor panel.

12. A collapsible tent assembly as claimed in claim 11 wherein said plurality of support means includes means for demountable attachement to the roof of an automotive vehicle.

13. A collapsible tent assembly as claimed in claim 12 and further comprising ladder means for supportive placement between said second planar floor panel and the ground when said second planar floor panel is in the second position thereof and said platform means is mounted on the roof of the automotive vehicle.

14. A collapsible tent assembly as claimed in claim 10 wherein each of said support frame means is of tubular construction having an arcuate bight portion with said pair of legs of said support frame means extendiang in parallel relationship from the opposite end of said arcuate bigh portion.

15. A collapsible tent assembly as claimed in claim 14 and further comprising a ridgepole having opposed ends for demountable attachment to the bight portions of said support frame means so as to extend therebetween when said support frame means are in their operative upstanding positions.

16. A collapsible tent assembly as claimed in claim 10 and further comprising a pair of cross rods extending horizontally between the extending ends of the legs of each of said support frame means for securing said tent cover to said platform means.

17. The collapsible tent assembly of claim 16, in which each end of each of said cross rods includes a slideably mounted sleeve member, said sleeve member defining a bore for receiving the extending end of one of said mounting pins.

* * * * *